United States Patent [19]

Hasegawa

[11] Patent Number: 4,725,755

[45] Date of Patent: Feb. 16, 1988

[54] PROJECTION TELEVISION RECEIVER WITH LIQUID-COOLED LENS

[75] Inventor: Shinichi Hasegawa, Tokyo, Japan

[73] Assignee: Pioneer Electronic Corporation, Tokyo, Japan

[21] Appl. No.: 893,205

[22] Filed: Aug. 5, 1986

[30] Foreign Application Priority Data

Aug. 6, 1985 [JP] Japan ..... 60-172652

[51] Int. Cl.[4] ..... H01J 29/86; H01J 7/26

[52] U.S. Cl. ..... 313/36; 313/44; 313/477 R; 358/250

[58] Field of Search ..... 313/35, 36, 44, 46, 313/477 R; 358/250; 220/2.1 A

[56] References Cited

U.S. PATENT DOCUMENTS 4,511,927 4/1985 Bauer ..... 358/231 X 4,529,905 7/1985 Ohkoshi et al. ..... 313/35

4,572,984 2/1986 Fitzpatrick ..... 313/478 X

*Primary Examiner*—David K. Moore

*Assistant Examiner*—Sandra L. O'Shea

*Attorney, Agent, or Firm*—Finnegan, Henderson, Farabow, Garrett, and Dunner

[57] ABSTRACT

A projection television receiver comprises at least one cathode ray tube for receiving video signals and projecting images therefrom, the tube including a face; a lens mounted adjacent to the face for focusing the images projected by the tube; and a coolant disposed between the lens and the face for absorbing and dissipating heat from the tube, the lens and the coolant having substantially the same refractive index for reducing reflection. The coolant may be a mixture of glycerol and ethylene glycol including about 20 to about 40% by weight of glycerol.

3 Claims, 8 Drawing Figures

PROJECTION TELEVISION RECEIVER WITH LIQUID-COOLED LENS

BACKGROUND OF THE INVENTION

1. Field of the Invention

The present invention generally relates to projection television receivers, and particularly relates to cooling liquids for cooling a projection cathode ray tube in a projection television receiver.

2. Description of the Background Art

Referring to FIG. 1, a conventional cooling system for a projection television receiver will be described.

In FIG. 1, a projection cathode ray tube 21 and a glass plate 22 are bonded with each other through a silicon group adhesive agent 24. A radiator 23 is interposed between the projection cathode ray tube 21 and a glass plate 22 such that a space is formed between the projection cathode ray tube 21 and a glass plate 22. The space is filled with cooling liquid A poured through a screw hole 23*a* opened to the radiator 23. The screw hole 23*a* is sealed by means of a packing 26 and a screw 25 after the cooling liquid has been inserted. The reference numeral 27 designates a lens.

When a signal is applied to the projection cathode ray tube 21, the front face of the cathode ray tube 21 is heated up. If there were no cooling system, as described above, the temperature would reach about 120° C. at the center portion of the front face and about 72° C. at the periphery of the same, and the temperature at the fluorescent surface of the projection cathode ray tube 21 could reach values higher by 20° C. than those at the front face.

Accordingly, if the above-mentioned space is filled with the cooling liquid A as described above, convection is effected in the cooling liquid A as shown in FIG. 2, in such a manner that the heat at the center portion of the projection cathode ray tube 21 is transmitted to the cooling liquid A and the heated cooling liquid A moves up to the radiator 23. Thus, the heat of the cooling liquid A is absorbed to be exhausted outside by the radiator 23. The thus cooled liquid A in the radiator 23 then moves down again by thermosiphoning into the space.

As the cooling liquid, a mixture of ethylene glycol and water is used with a ratio of the former to the latter of about 4:1. The physical properties of the cooling liquid are as shown in the following Table.

Since the refractive index of the cooling liquid A is 1.41, the reflection factor ($R_1$, $R_2$) at the boundary in the structure as shown in FIG. 1 is as follows.

$$R1 = R2 = \left(\frac{1.54 - 1.41}{1.54 + 1.41}\right)^2 \times 100 = 0.19\%$$

where 1.54 is a value of the refractive index of the glass. Thus, the total reflection factor at the boundaries between the cooling liquid A and the projection cathode ray tube 21, and between the cooling liquid A and the glass plate 22 reaches 0.38%. This has been a cause of a marked decrease in contrast in conventional projection television receivers.

Since the cooling liquid A contains 20% of water, the vapor pressure reaches 0.47 atm at a temperature of 100° C., and this vapor pressure acts directly on the projection cathode ray tube 21, as well as the glass plate 22, with a risk of damage of those components.

TABLE

| | Cooling liquid of the Invention Mixture of ethylene glycol and glycerol (30% by weight) | Cooling liqud of the Prior Art Mixture of ethylene glycol and water (20% by weight) |
|---|---|---|
| Refractive index | 1.444 | 1.41 |
| Boiling point | 205° C. | 126° C. |
| Solidifying point (Melting point) | −75.3° C. | −45° C. |
| Flash point | 132° C. | 118° C. |
| Thermal conductivity | $6.47 \times 10^{-4}$ cal/cm · s · deg | $7.3 \times 10^{-4}$ cal/cm · s · deg |
| Vapor pressure | | |
| 80° C. | 0.003 (atm) | 0.22 (atm) |
| 100° C. | 0.011 (atm) | 0.47 (atm) |
| 120° C. | 0.026 (atm) | 0.94 (atm) |

If the glass plate 22 is replaced by a plastic lens, the plastic material of the lens may absorb the water and become cloudy white because the cooling liquid contains a large quantity, about 20%, of water. Accordingly, a plastic lens cannot be used at the point where the lens comes into contact with the water. Therefore if a plastic lens is used, it must be disposed in front of a heavier glass plate 22 preventing any substantial reduction in weight or cost.

It is an object of the present invention to provide a liquid lens for a projection television receiver, in which the reflection factor at boundaries can be made smaller to make the contrast higher, in which the vapor pressure can be low to eliminate the risk of damage of the projection cathode ray tube or the like, and in which a plastic lens can be used and the plastic lens can constitute a direct cooling surface. Thus, it is possible to reduce the weight, as well as the cost of the device.

Other features and advantages of the invention will be apparent from the following description taken in connection with the accompanying drawings.

SUMMARY OF THE INVENTION

In order to achieve the above objects and advantages, the projection television receiver of the present invention comprises at least one cathode ray tube for receiving video signals and projecting images therefrom, the tube including a face; lens means mounted adjacent to the face for focussing the images projected by the tube; and coolant means between the lens means and the face for absorbing and dissipating heat from the tube, the lens means and the coolant means having substantially the same refractive index, for reducing reflection of the images.

Preferably, the coolant means includes a liquid mixture of glycerol and ethylene glycol, and it is preferred that the mixture include from about 20 to about 40% by weight of glycerol.

The term "television receiver" is intended to mean a television receiver, a monitor or the like.

BRIEF DESCRIPTION OF THE DRAWINGS

The accompanying drawings, which constitute a part of the specification, illustrate, except for FIG. 1, one embodiment of the invention, and, together with the description, serve to explain the principles of the invention. Of the drawings.

DESCRIPTION OF THE PREFERRED EMBODIMENT

Figure 1:
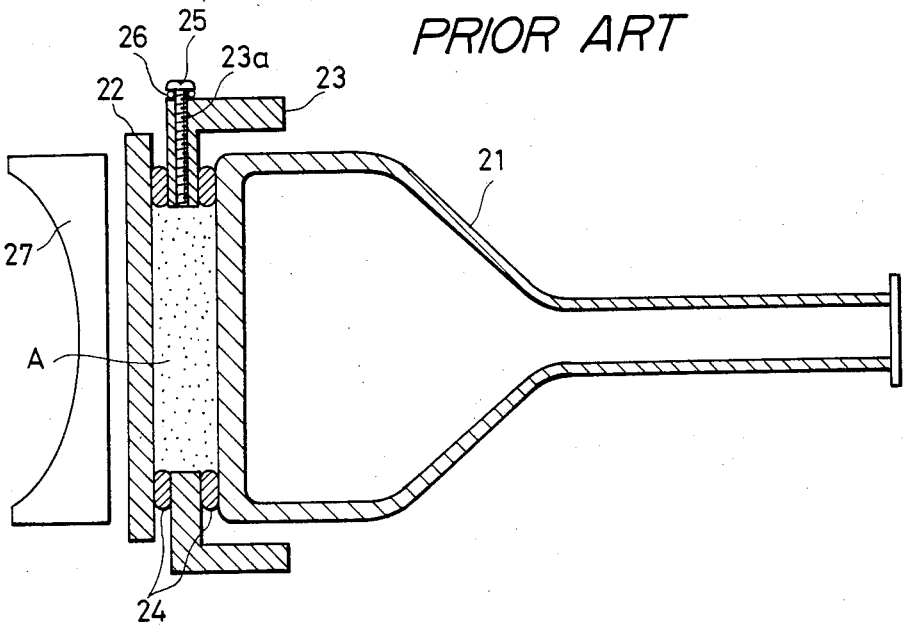
FIG. 1 PRIOR ART
FIG. 1 is a cross-section of the conventional projection cathode ray tube provided with a cooling system.
Figure 2:
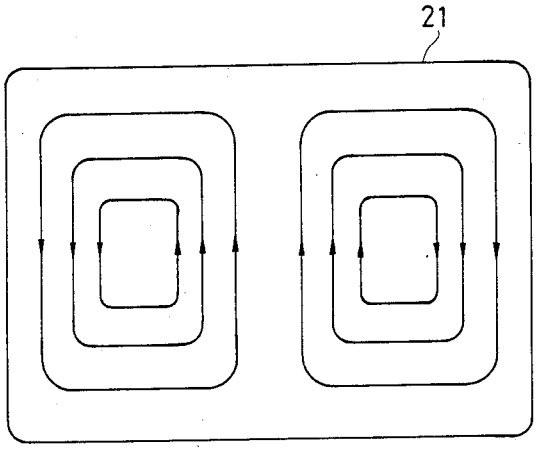
FIG. 2 is an explanatory diagram showing the convection of the cooling liquid on the front face of the projection cathode ray tube.
Figure 3:
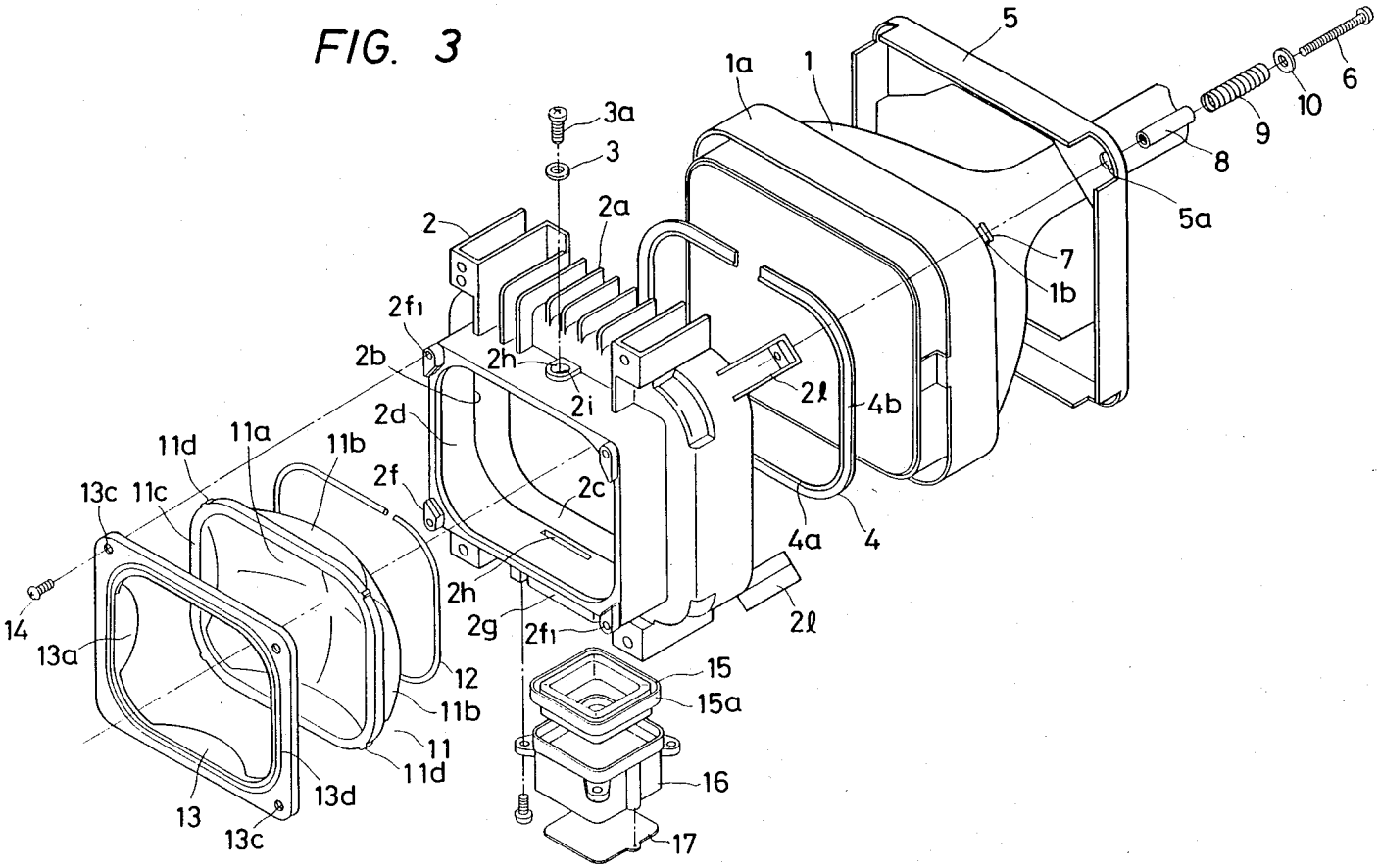
FIG. 3 is an exploded perspective view of the whole projection apparatus.
Figure 4:
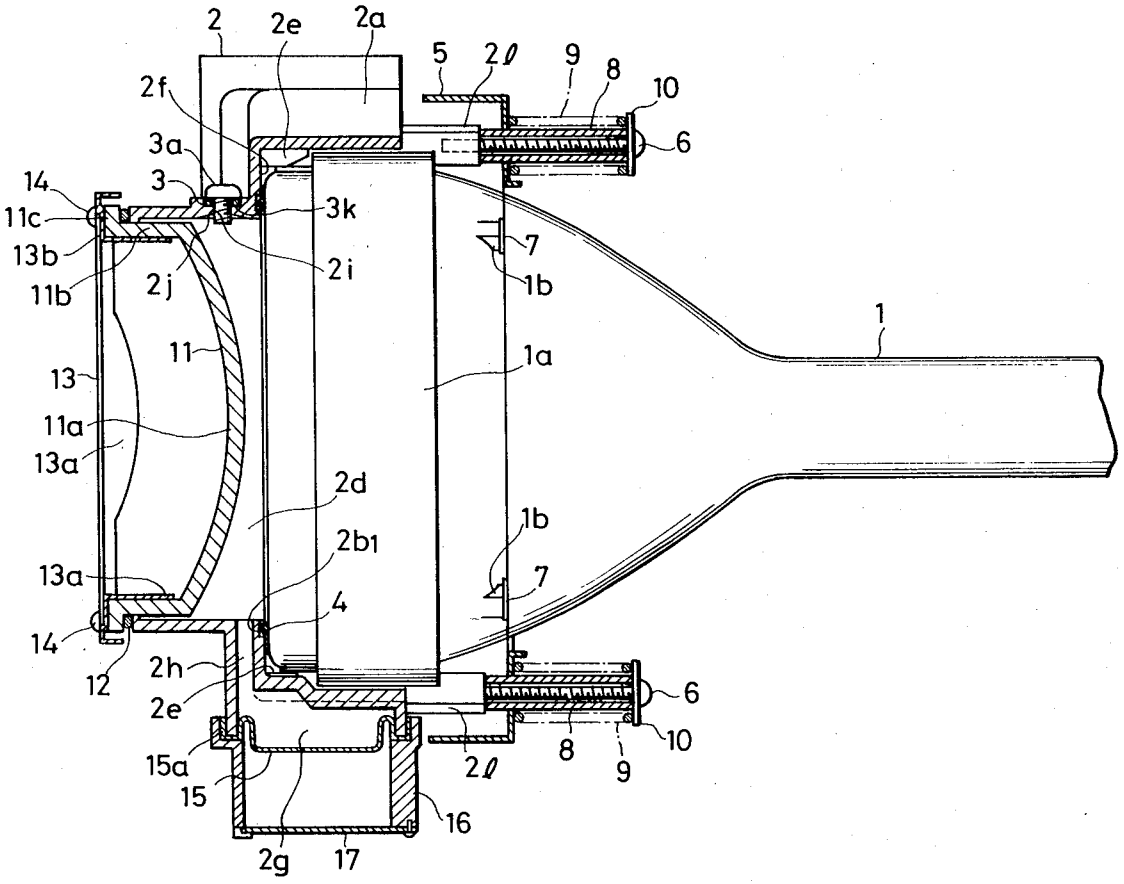
FIG. 4 is a cross-section showing the assembled state of FIG. 3.
Figure 5:
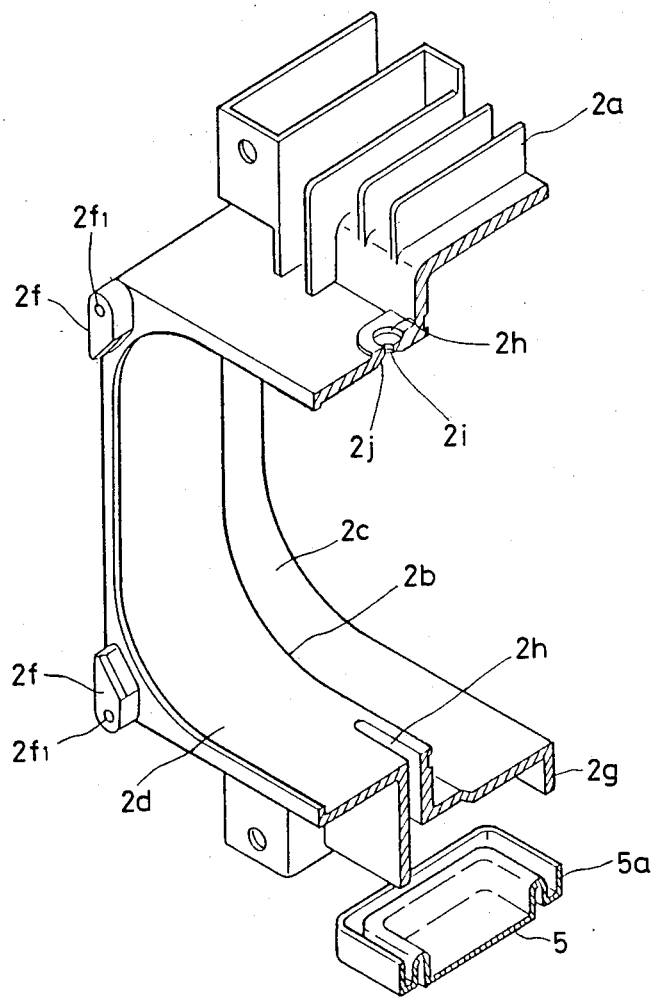
FIG. 5 is a perspective sectional view of the frame portion.
Figure 6:
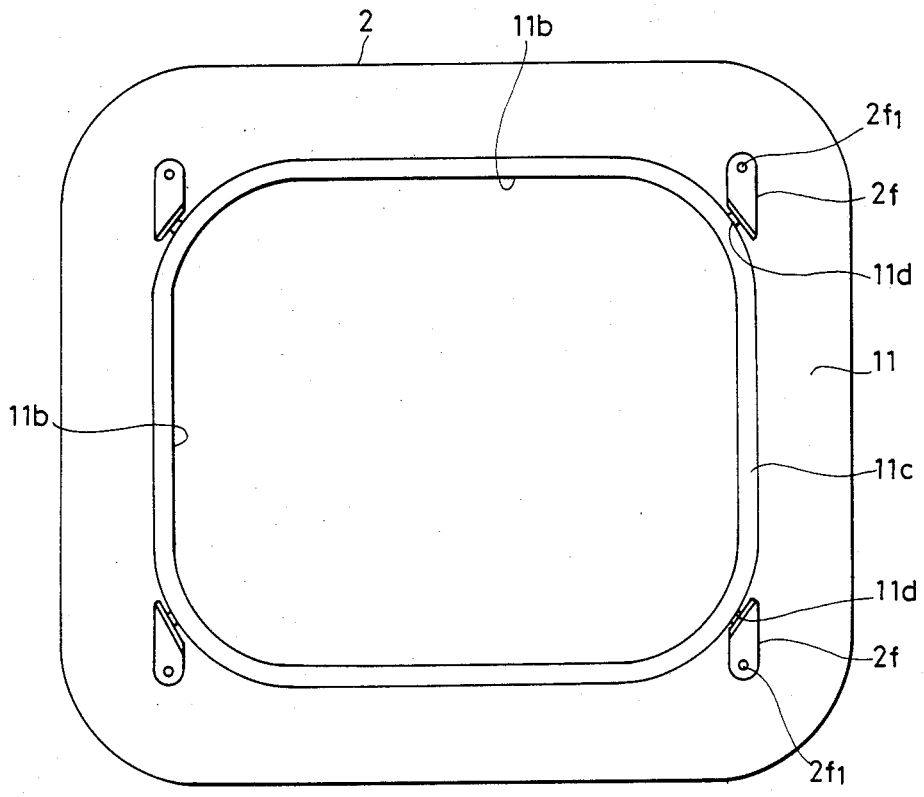
FIG. 6 is a front view showing the state where the lens has been mounted on the frame.
Figure 7:
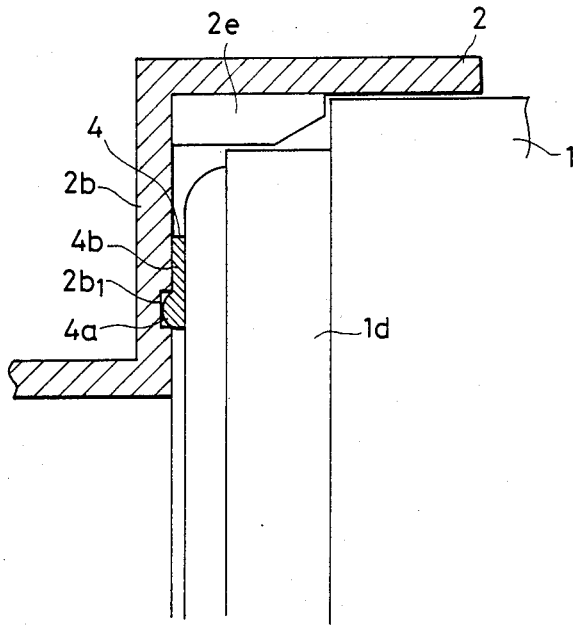
FIGS. 7 and 8 are enlarged sectional views of parts of FIG. 4.
Figure 8:
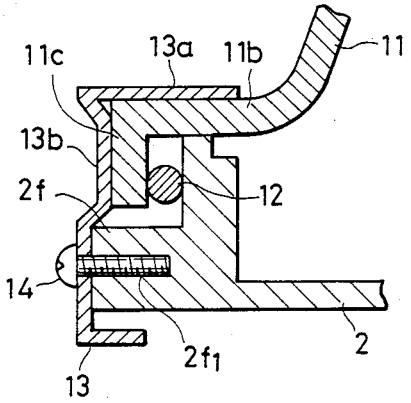

Referring to the drawings, the present preferred embodiment now will be described. In the illustrated embodiment, description is made as to one of three monochromatic projection cathode ray tubes constituting a projection television receiver.

In the drawings, a projection cathode ray tube 1 is provided with a metal belt 1*a* secured to a side edge outer periphery thereof close to a fluorescent screen thereof for interrupting emission of X-rays. A frame 2 of die-cast aluminum is provided with a large number of fins 2*a* formed on an upper portion of an outer peripheral surface thereof. A step portion 2*b* is located at an inner central portion of the frame 2 to form a large-sized chamber 2*c* for mounting the projection cathode ray tube 1 therein. This projection cathode ray tube chamber 2*c* is formed at one side of the step portion 3*b*, and a small-sized chamber 2*d* for enclosing a cooling liquid A (described later) is formed at the other side of the step portion 2*b*.

Respective protrusions 2*e* are formed at the four corners of the inner surfaces of the side walls defining the projection cathode ray tube chamber 2*c*, such that the protrusions 2*e* abut on the side edge outer periphery of the projection cathode ray tube 1. This disposes the projection cathode ray tube 1 in position on the frame 2. Respective protrusions 2*f*, on the other hand, are formed at the four corners of the end surfaces of the side walls defining the cooling liquid chamber 2*d* such that the protrusions 2*f* abut on small protrusions 11*d* of a lens 11 described later. This disposes the lens 11 in position on the frame 2. Thus, the center line of the projection cathode ray tube 1 is made coincident with that of the lens 11 because the projection cathode ray tube 1 and the lens 11 can be disposed in position on the frame 2. Further, a through hole 2*h* is formed in the frame 2. One end of the through hole 2*h* is opened to the inside of the lower side wall defining the cooling liquid chamber 2*d*, and the other end of the through hole 2*h* is opened to a pressure regulating chamber 2*g* formed under the lower side wall defining the projection cathode ray tube chamber 2*c*. A cooling liquid pouring hole 2*i* is formed at a center portion of the upper side wall defining the cooling liquid chamber 2*d*. The upper surface of the upper side wall is tapered toward the cooling liquid pouring hole 2*i*. The upper side wall also has a lower taper surface 2*j*, tapered to the lower edge of the cooling liquid pouring hole 2*i*, so that the upper side wall defining the cooling liquid chamber 2*d* has double taper surfaces. A large diameter hole portion 3*k* is formed at the upper end of the cooling liquid pouring hole 2*i*, so that the packing 3 can be fitted into the large diameter hole portion 3*k*.

A thin-plate ring-like rectangular packing 4 is provided with an expanded inner edge portion 4*a*, which is rectangular in section and which is sized to fit into a slot $2b_1$ formed in the inner surface of the step portion 2*b* of the frame 2.

A metal pressing plate 5 is inserted onto the projection cathode ray tube 1 from the rear for fixing the projection cathode ray tube 1 on the frame 2.

The projection cathode ray tube 1 is inserted into the frame 2 with the projection face of the projection cathode ray tube 1 facing the projection cathode ray tube chamber 2*c* of the frame 2. The projection face of the projection cathode ray tube 1 comes into abutting relation with the packing 4, because the packing 4 has been disposed in the slot $2b_1$ of the step portion 2*b* of the frame 2. The pressing plate 5 is inserted onto the projection cathode ray tube 1 from the rear, and respective screws 6 are inserted into through holes 5*a* of the pressing plate 5 to be tightened into frame attaching pillar portions 2*l*. This fixes the projection cathode ray tube 1 securely on the frame 2. The pressing plate 5 abuts, via elastic materials 7, against supporting portions 1*b* which project from the back surface of the projection cathode ray tube 1. Thus, the projection cathode ray tube 1 is attached onto the frame 2 so that the packing 4 is deformed by the fastening force of the screws 6 (at four corners of the pressing plate 5).

If the pressing force of the projection cathode ray tube 1 exerted onto the whole packing 4 is not uniform, a gap may be partially produced between the projection cathode ray tube 1 and the frame 2. This allows the cooling liquid to leak through the gap even when small amounts of vapor are produced, as will be described later. Therefore, it is necessary to uniformly fasten the pressing plate 5 onto the frame 2. In this embodiment, accordingly, a spacer 8 is inserted into each of the holes 5*a* of the pressing plate 5 so that one end of the spacer 8 made to abuts on the respective frame attaching pillar portion 2*l*. A spring 9 is fitted onto the outer periphery of the spacer 8 with one end of the spring 9 made to abut on the pressing plate 5. Then, the respective screw 6 with a washer inserted thereto is screwed into the corresponding frame attaching pillar 2*l* through the spacer 8, and fastened so as to make the washer 10 abut against the other end of the spacer 8. This compresses the spring 9. As a result, the pressing plate 5 presses the projection cathode ray tube 1 at four portion thereof by the spring force of the springs 9 to urge the projection cathode ray tube 1 against the packing 4 under a uniform pressing force. Thus, no gap is generated between the step portion 2*b* of the frame 2 and the projection face of the projection cathode ray tube 1.

The lens 11 made of acrylic resin or the like has only one curved surface 11*a* with a predetermined radius of curvature, and includes four sides which are cut-off so as to form right angles between adjacent sides thereof so as to appear rectangular in plan. A perpendicular wall portion 11*b* is formed in each of the four cut-off sides and a collar portion 11*c* is formed integrally with the lens 11 along the whole periphery thereof.

The four corners of the lens surface 11*a* are rounded in order to prevent a crack from being generated at the corner portions when a pressure is applied to the curved surface 11*a* in this embodiment. However, it is not always necessary to round the corners. Further, small protrusions 11*d* are formed at corner portions of the collar portion 11c so as to abut on the protrusions 2f of the frame 2, respectively.

A packing 12 having a circular cross-section is fitted on the collar portion 11c of the lens 11. A metal lens adaptor plate 13 is sized to surround the collar portion 11c of the lens 11. Light-shading portions 13a, sized for fitting on inner surfaces of the respective perpendicular wall portions 11b of the lens 11, are formed integrally with the lens adaptor plate 13. A step portion 13b, arranged for mating with the collar portion 11c of the lens 11, is formed in the lens adaptor plate 13.

The lens 11 is disposed on the end surface of the side wall constituting the cooling liquid chamber 2d of the frame 2 with the curved surface 11a made to face the lens adaptor plate 13. The packing 112 is interposed between the collar portion 11c of the lens 11 and the end surface of the side wall defining the cooling liquid chamber 2d. The small protrusions 11d of the lens 11 are made to abut on the side surfaces of the protrusions 2f of the frame 2, respectively, to thereby guide the lens 11 in to position on the frame 2.

The lens adaptor plate 13 surrounds the collar portion 11c of the lens 11. Respective screws 14 are inserted into holes 13c formed in the four corners of the lens adaptor plate 13, and are tightened into screw holes $2f_1$. The holes $2f_1$, are formed in upper surfaces of the protrusions 2f of the frame 2. Thus, the lens 11 is securely fixed on the frame 2. The collar portion 11c of the lens 11 is attached on the frame 2 in sandwich relationship between the step portion 13b of the lens adaptor plate 13 and the packing 12. Thus, only compression stress is exerted onto the collar portion 11c, with no bending stress.

Although the step portion 13b is formed in the lens adaptor plate 13 in this embodiment, a projection alternatively may be formed on the collar portion 11c of the lens 11 at a position opposite to the lens adaptor plate 13.

At least the light-shading portions 13a of the lens adaptor plate 13 are made opaque, for example, by being painted black, so that light transmitted through the lens 11 is not reflected by the lens adaptor plate 13.

The pressure regulating chamber 2g of the frame 2 is covered with a diaphragm 15. A fastening ring 16 is fitted on the outer periphery 15a of the diaphragm 15 and fixed on the frame 2 by screws. Thus, the diaphragm 15 is fixed at an opening portion of the pressure regulating chamber 2g of the frame 2 by the fastening ring 16. An opening of the fastening ring 16 is covered by a cap 17.

The functioning of the projection apparatus according to the present invention will now be described.

First, the projection cathode ray tube 1 is mounted onto the projection cathode ray tube chamber 2c of the frame 2 having the fins 2a. At this time, the packing 4 is disposed in the slot $2b_1$ of the step portion 2b, and the projection face of the projection cathode ray tube 1 is caused to abut against the packing 4. In this state, the four-corner portions of the projection cathode ray tube 1 abut against the protrusions 2e inwardly projectingly formed on the inner surfaces of the four corners of the projection cathode ray tube chamber 2c. Thus, the projection cathode ray tube 1 is disposed in position on the frame 2. The pressing plate 5 is then inserted from the rear of the projection cathode ray tube 1, and mounted on the supporting portions 1b formed on the back surface of the projection cathode ray tube 1 through the elastic materials 7, respectively. The screws 6, each having the washer 10, the spring 9, and the spacer 8 fitted thereon in that order, are inserted into the respective holes 5a of the pressing plate 5 and are screwed into the respective frame attaching pillar portions 2l. Further, the screws 6 are tightened so as to make the washers 10 abut on the corresponding spacers 8, thereby fixing the pressing plate 5 and the frame 2 to each other by the spring force of the respective springs 9. Thus, the projection cathode ray tube 1 is pressed at its four corners by the spring force of the springs 9, respectively. Therefore, the projection cathode ray tube 1 is fixed on the step portion 2b of the frame 2 in a sealed state by the uniform force. It is easy to dispose the packing 4 in place on the frame 2, because the expanded portion 4a of the packing 4 is fitted in the slot $2b_1$ of the step portion 2b of the frame 2. Further, the contact area between the projection cathode ray tube 1 and the packing 4 is made large because the expanded portion 4a and the flat portion 4b of the packing 4 come into contact with the projection cathode ray tube 1, and the expanded portion 4a is substantially deformed when the projection cathode ray tube 1 is urged against the expanded portion 4a. Therefore, it is possible to keep a fluid-tight seal between the projection cathode ray tube 1 and the step portion 2b of the frame 2.

The lens 11 is mounted then onto the frame 2. First, the packing 12 is fitted on the collar portion 11c of the lens 11, and the lens 11 is mounted on the frame 2 so as to insert its one side having the packing 12 into the opening of the frame 2, and to insert the other side or curved surface side of the lens 11 into the cooling liquid chamber 2d of the frame 2. The small protrusions 11d formed at the four corners of the lens 11 are made to abut against the protrusions 2f of the frame 2, respectively, to thereby dispose the lens 11 in correct position on the frame 2. Thus, a predetermined positional relationship can be always maintained between the projection cathode ray tube 1 and the lens 11, both of which are disposed in position on the frame 2.

The lens adaptor plate 13 is fitted on the lens 11, and the screws 14 are tightened into the protrusions 2f of the frame 2, so that the lens 11 is securely attached onto the frame 2. When the lens 11 is attached onto the frame 2 through this lens adaptor plate 13, the collar portion 11c of the lens 11 is sandwiched between the packing 12 and the step portion 13b of the lens adaptor plate 13. The packing 12 and the step portion 13b are disposed at the opposite side surfaces of the collar portion 11c, so that the whole collar portion 11c of the lens 11 is pressed uniformly. Accordingly, no bending stress is exerted onto the collar portion 11c of the lens 11, so that the lens 11 is not damaged. Further, the lens 11 has a cross section in plan view in the shape of a circle cut at four edges at right angles to be rectangular. Therefore the lens 11 can be reduced in size, even where the lens 11 has a large radius of curvature. Accordingly, it is possible to dispose the projection cathode ray tubes more closely adjacent to each other, so that the respective optical axes of the projection cathode ray tubes are made substantially equal in length to each other. This makes it possible to make the color tone more uniform in intensity.

Further, the lens 11 is shaped to be substantially rectangular in plan view with substantially perpendicular wall portions 11b. As a result, there is a possibility that projection light rays from the lens 11 may be reflected by the perpendicular wall portions 11b to interfere with other such rays. Therefore, in this embodiment, light-shading portions 13*a* each having a size substantially the same as the perpendicular wall portion 11*b* are formed on the lens adaptor plate 13 and are coated to prevent reflection. The respective light-shading portions 13*a* are arranged on the respective inner surfaces of the perpendicular wall portions 11*b* of the lens 11 to prevent the projection light from being reflected, so that no interfering light is generated.

The diaphragm 15 is fitted onto the pressure regulating chamber 2*g* of the frame 2 and the fastening ring 16 is fastened onto the frame 2 by screws to thereby fix the diaphragm 15 on the frame 2. The cap 17 is attached onto the opening of the fastening ring 16.

The cooling liquid A is poured into the cooling liquid pouring hole 2*i* of the frame 2 so as to fill a space defined by the diaphragm 15, the projection face of the projection cathode ray tube 1, and the curved surface of the lens 11, with the cooling liquid A. There is a possibility that air may remain in an upper portion of the space after the space has been filled with the cooling liquid A. Therefore, in this embodiment, the taper surface 2*j* is formed in the lower surface of the cooling liquid pouring hole 2*i* so that air can be discharged out of the cooling liquid pouring hole 2*i* along the taper surface 2*j*. As a result, air never remains in the space, and the space is completely filled with the cooling liquid A. The packing 3 is attached onto the cooling liquid pouring hole 2*i* by a screw 3*a* to seal the cooling liquid A.

Although the cooling liquid pouring hole 2*i* is sealed by the packing 3 and the screw 3*a* in this embodiment, alternatively, a hollow rubber member with a flange may be used. That is, the hollow rubber member may be inserted into the cooling liquid pouring hole 2*i*, and a plug made of stainless steel, aluminum alloy, brass, or the like, may be fitted into a hollow portion of the hollow rubber member. In this case, an expanded portion is formed on an inner periphery of the hollow portion of the hollow rubber member at a lower portion of the rubber member to be projected down from the lower surface of the cooling liquid pouring hole 2*i*. The expanded portion is extended outward when the plug is tightened into the hollow portion to thereby tightly seal the lower surface of the cooling liquid pouring hole 2*i*. This improves the sealing of the cooling liquid pouring hole 2*i*.

When this cooling liquid A is sealed, if a signal is applied to the projection cathode ray tube 1 and the projection cathode ray tube 1 is heated, the cooling liquid A is expanded. However, the expansion of the cooling liquid A can be absorbed by the diaphragm 15, so that an excess pressure is not applied to the projection cathode ray tube 1 and the lens 11. Further, the temperature of the cooling liquid A is kept lower than a predetermined value, because the cooling liquid A is circulated in the space to be cooled by the frame 2.

Further, if the temperature of the cooling liquid A is increased, the lens 11 is heated and expands to cause the four corners of the lens 11 to abut against the protrusions 2*f* of the frame 2, respectively. Thus, stress is exerted onto the lens 11 creating a risk of damage of the lens 11. In this embodiment, however, the small protrusions 11*d* are formed at the four corners of the lens 11, respectively, so that the small protrusions may be deformed to avoid any stress exerted on the lens 11, and to prevent the lens 11 from being damaged.

According to the present invention, a mixture consisting of ethylene glycol and 20–40% by weight of glycerol is used as the cooling liquid A.

Accordingly, the reflection factor $R_1$ at the boundary between the front face of the projection cathode ray tube 1 and the cooling liquid A becomes $$R1 = \left(\frac{1.54 - 1.444}{1.54 + 1.444}\right)^2 \times 100 = 0.104\%$$

where 1.54 and 1.444 are values of the refractive indices of the glass and the cooling liquid A, respectively. The reflection factor $R_2$ at the boundary between the plastic lens 11 and the cooling liquid A becomes $$R1 = \left(\frac{1.492 - 1.444}{1.492 + 1.444}\right)^2 \times 100 = 0.027\%$$

where 1.492 is a value of the refractive index of the plastic material.

Accordingly, the total reflection factor becomes 0.131%, which is a value smaller than a half of that in the case where the conventional cooling liquid is used. Thus the contrast of the projection from the projection cathode ray tube 1 can be extremely improved. The cooling liquid A has substantially the same refractive index as the lens 11, and also acts as a liquid lens.

Therefore, the transmittance loss of light projected from the cathode ray tube 1 through the lens 11 is sufficiently small that a high-quality picture can be obtained.

Further, since glycerol is used in place of water which has been used in the prior art, it is possible to suppress the vapor pressure of the cooling liquid to a value lower than that of the liquid conventionally used. This is because the vapor pressure of the glycerol, per se, has a very low value not higher than 0.01 mHg at 10° C. Accordingly, the projection cathode ray tube 1, as well as the lens 11, can be prevented from being damaged due to excessive pressure. In addition, losses in the quantity of the cooling liquid A due to evaporation and leaking can be suppressed. As discussed previously, the cooling liquid A may be evaporated and if the quantity of vapor is large, the vapor may leak out through the packing or the like made of silicone resin, which has gas permeability.

Further, since the cooling liquid A does not dissolve the plastic material, it is possible to dispose the plastic lens 11 in direct contact with the cooling liquid. Therefore it is unnecessary to use the glass plate 2, which has been used in the prior art. The space to be filled with the cooling liquid can be widened, if it is assumed that the distance between the projection cathode ray tube 1 and the lens 11 is equal to that in the conventional case. This improves the cooling efficiency of the tube correspondingly. According to the present invention, the temperatures at the central portion of the projection cathode ray tube 1 and at the peripheral portion of the tube are 68° C. and 55° C., respectively. Thus, the temperature at the central portion of the projection cathode ray tube 1 is lower than that in the prior art device by 52° C., and the temperature difference between the central portion and the peripheral portion of the projection cathode ray tube 1 is only 13° C. Accordingly, it is possible to reduce the thermal stress exerted onto the projection face of the projection cathode ray tube 1, and to thereby improve the reliability of the projection apparatus.

As described above, according to the present invention, the cooling liquid used for cooling the front face of the projection cathode ray tube comprises a mixture of ethylene glycol and 20–40% by weight of glycerol. Accordingly, it is possible to significantly increase the contrast in comparison with the prior art because the reflection factor at the boundaries can be reduced to a low level. It is also possible to prevent the projection cathode ray tube or the like from being damaged as a result of evaporation of cooling liquid and the low level of vapor pressure of the cooling liquid. In addition, the apparatus may be reduced in size and may be manufactured at a lower cost because a plastic lens may be placed in direct contact with the cooling liquid.

It is understood that various modifications and variations could be made in the invention without departing from the scope of or spirit of the invention.

What is claimed is:

1. A projection television receiver comprising at least one cathode ray tube for receiving video signals and projecting images therefrom, said tube including a face;

lens means mounted adjacent said face for focusing the images projected by said tube; and coolant means between said lens means and said face for absorbing and dissipating heat from said tube, said lens means and said coolant means having substantially the same refractive index for reducing reflection of said images, wherein said coolant means is a substantially waterless liquid mixture consisting essentially of glycerol and ethylene glycol having from about twenty to about forty percent by weight of glycerol.

2. A liquid lens for a projection television receiver, the receiver including at least one cathod ray tube having a face thereon, comprising:

a transparent surface aligned for receiving light from said tube;

frame means attached to said surface and said face of said tube, and defining therewith an enclosed liquid-tight chamber between said transparent surface and said face; and a substantially waterless liquid mixture consisting essentially of glycerol and ethylene glycol disposed in said chamber, wherein said substantially waterless liquid mixture has from about twenty to about forty percent by weight of glycerol.

3. The liquid lens of claim 2 wherein said transparent surface is a plastic lens.

* * * * *